US005423690A

United States Patent [19]

Selker et al.

[11] Patent Number: 5,423,690

[45] Date of Patent: Jun. 13, 1995

[54] UNIVERSAL ELECTRICAL POWER PLUG FOR MULTINATION USE WITH SELF-SETTING CONTACT PINS

[75] Inventors: Edwin J. Selker, Palo Alto; William M. Dyer, San Jose, both of Calif.

[73] Assignee: International Business Machines Corporation, Armonk, N.Y.

[21] Appl. No.: 191,306

[22] Filed: Feb. 3, 1994

[51] Int. Cl.[6] ..... H01R 29/00

[52] U.S. Cl. ..... 439/172; 439/173

[58] Field of Search ..... 439/172, 173, 174

[56] References Cited

U.S. PATENT DOCUMENTS

| | | | |
|---|---|---|---|
| 2,989,719 | 6/1961 | Aarlaht | 439/173 X |
| 3,025,486 | 3/1962 | Falconer | 439/172 X |
| 4,518,212 | 5/1985 | Rumble | 339/31 |
| 4,543,624 | 9/1985 | Rumble | 363/146 |
| 4,626,052 | 12/1986 | Rumble | 439/173 |
| 4,815,983 | 3/1989 | Erickson et al. | 439/173 |
| 5,085,591 | 2/1992 | Warren, Sr. et al. | 439/172 X |

FOREIGN PATENT DOCUMENTS

| | | |
|---|---|---|
| 2097202 | 10/1982 | United Kingdom . |
| 9311588 | 6/1993 | WIPO . |

*Primary Examiner*—Z. R. Bilinsky

*Attorney, Agent, or Firm*—Henry E. Otto, Jr.

[57] ABSTRACT

An electrical plug selectively insertable into receptacles having different configurations of apertures for effecting selectable electrical connections. A plurality of contact prongs have extended positions in which they project exteriorly of a housing. Each of an appropriate subset of these prongs is adapted automatically to sense and enter matching apertures of a selected receptacle. The remaining prongs during such entry are moved inward of the housing by contact with and movement relative to a surface of the selected receptacle adjacent to the apertures, and cause prongs of the subset to be locked in their extended positions as they enter the matching apertures.

15 Claims, 7 Drawing Sheets

UNIVERSAL ELECTRICAL POWER PLUG FOR MULTINATION USE WITH SELF-SETTING CONTACT PINS

TECHNICAL FIELD

This invention relates to electrical power plugs adaptable to meet the differing wall outlet standards of various nations, and generally relates to such an electrical plug which automatically selects, for a variety of national standard configurations, a proper configuration of contact pins when the plug is being inserted in a wall or other receptacle.

BACKGROUND OF THE INVENTION

A universal electrical power plug that enables direct connection of a power cord to a power source obviously is preferable to an adaptor which mates the power cord with the source. Adaptors can get lost. Also, they are not acceptable in most countries as a mode to correct an appliance with a power source. A universal plug can desirably reduce weight in products, such as laptop computers, that are user moved between and/or sold to nations with different standards for their power source outlets. Finally, use of a universally acceptable power plug reduces the variety of different plug configurations and hence the amount of inventory required for internationally marketed products.

Numerous configurations of universal electrical power plugs or adaptors have heretofore been proposed. The following constitutes the prior art known to applicant considered most pertinent to the present invention.

PCT WO 93/11588 discloses an electrical adaptor configured to permit an electrical plug with contact pins according to one national standard to be inserted into apertures in a power outlet arranged according to another national standard. Contact pins or prongs are slidably retained in elongated holes in a pin housing. A rotatable selector plate permits contact pins appropriate to a selected national standard to be uncovered, withdrawn from the retaining holes, then manually screw threaded into threads provided adjacent to the outer ends of the holes. A cowling, which encircles the pin housing, is normally spring biased to cover the contact pins, as required by a German standard; but the cowling is forced back against the spring bias to expose the contact pins as the adaptor is mated with the wall outlet.

U.S. Pat. No. 4,626,052 discloses a multipin adaptor comprising a plurality of slidable carriers, each carrying an array of contact pins that suits a respective national standard. By manually sliding the appropriate carrier, the proper array of pins is extended and locked. The pins remain extended until a lug is depressed and flees a detent to permit manual retraction of the carrier and thereby of the pin array.

U.S. Pat. No. 4,543,624 is of interest as showing a pair of two-part contact pins, each having a flat front part and a cylindrical rear part that has limited rotation about its axis. This permits the front parts to be rotated to parallel for an American socket and angled for an Australian/New Zealand socket.

Other prior art considered to be of incidental interest but showing still other configurations of electrical power plugs or adaptors are U.S. Pat. Nos. 4,815,983, 4,518,212, and 3,025,486; and United Kingdom Patent GB 2,097,202A.

There is a need for a universal electrical power plug that (i) senses and automatically selects the appropriate configuration of contact prongs as the plug engages a wall outlet or other receptacle; (ii) requires no manual selection or screw threading; (iii) is compact, requiring no more volume than a conventional British power plug; and (iv) can adapt to standard U.S., European, British, German, and Australian/New Zealand sockets.

SUMMARY OF THE INVENTION

An electrical plug is provided which is selectively insertable into receptacles having different configurations of apertures for effecting selectable electrical connections. A plurality of contact prongs have extended positions in which they project exteriorly of a housing. Each of an appropriate subset of these prongs is adapted automatically to sense and enter matching apertures of a selected receptacle, while the remaining prongs are moved inward of the housing by contact with and movement relative to a surface of the selected receptacle adjacent to the apertures causing at least some of the prongs of the subset to be latched in extended position as they enter the matching apertures. A single button is manually depressible from a normal position to another position to concurrently free all contact prongs from restraint and permit them to be restored to their extended positions.

The contact prongs may include a pair of rectangular prongs having facing longitudinally extending semicylindrical grooves and a pair of semicylindrical prongs slidably accommodated in said grooves. The rectangular prongs and semicylindrical prongs are latched together to constitute a British-type prong, but the rectangular prongs are movable longitudinally inward of the housing means relative to the semicylindrical prongs to constitute a European prong.

The plug may include a pair of fixed blade-like power prongs that extend from the housing and a pair of longitudinally slidable ground prongs having extended positions in which they project exteriorly of the housing. The ground prongs automatically sense and enter aligned matching apertures in the selected receptacle or move inwardly of the housing by contact with and movement relative to a surface of the selected receptacle in the absence of the matching apertures.

The plug may comprise a pair of prongs having extended positions in which they project exteriorly of the housing. Each prong of the pair comprises two normally aligned rectangular blade members and an element interconnecting the members in such a manner as to permit one to twist relative to the other. Both one members are biased to respective positions in which they are parallel to each other and adapted to enter parallel apertures in a selected receptacle without twisting. Both have chamfered aperture-sensing ends to facilitate sensing and concurrent twisting during entry into angled apertures in the selected receptacle.

DESCRIPTION OF THE PREFERRED EMBODIMENT

As used in the specification and claims, the term "prong" is intended generically to connote a circular contact pin, a flat blade contact (like the parallel power contacts of a conventional U.S. plug) or variously-shaped prongs or other contact members insertable into power or ground outlets configured according to any of a plurality of national standards.

Figure 1:
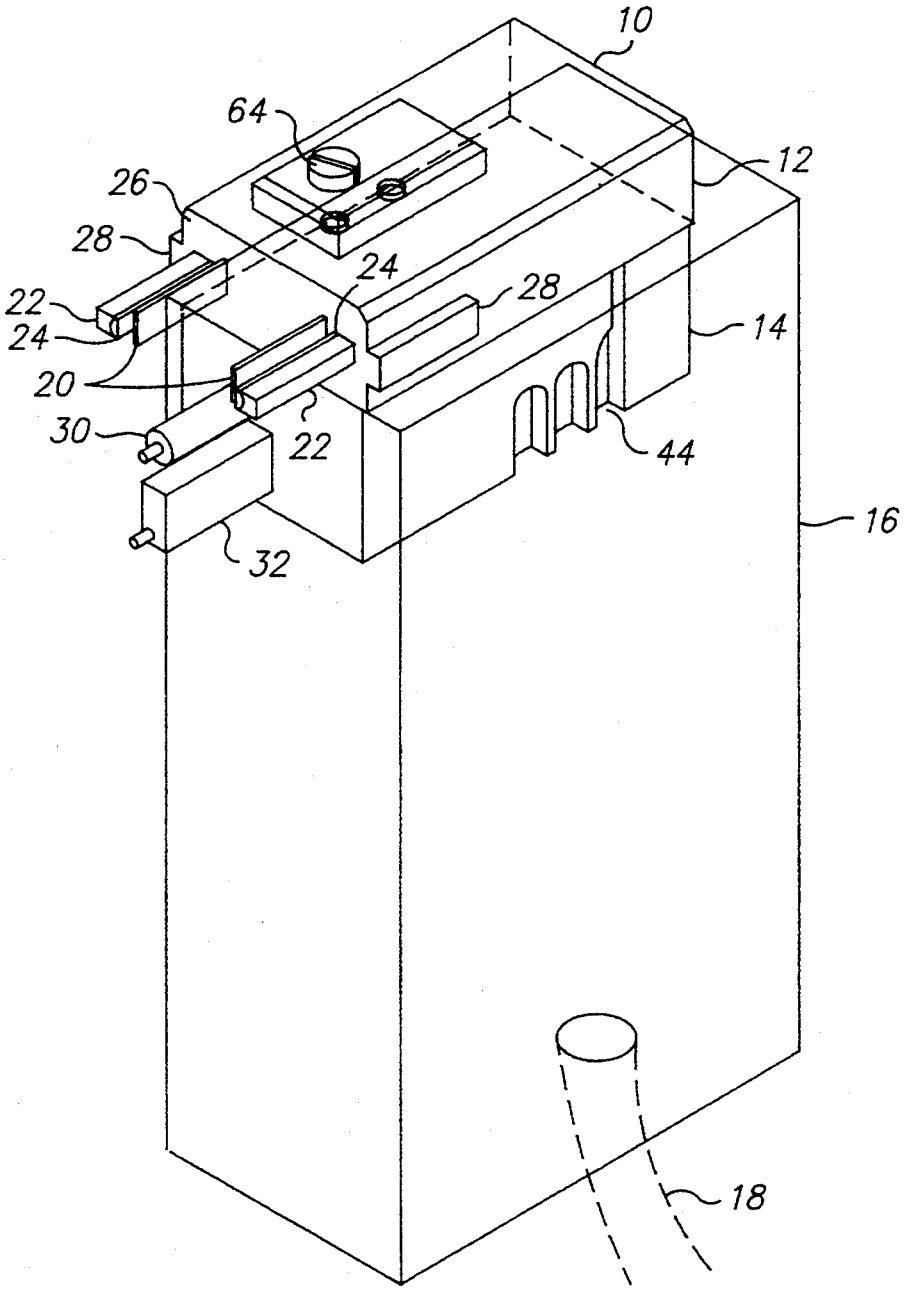
FIG. 1 is an isometric view of a universal electrical power plug embodying the invention which, as shown, is formed integrally with a power supply.

As illustrated in FIG. 1, the universal electrical power plug 10 embodying the invention comprises upper and lower housing portions 12, 14, respectively. As shown, lower housing portion 14 is formed integrally with a power supply 16 that is connectable by a cord 18 to a power source (not shown). Power supply 16 preferably is a commercially available AC adaptor of the type, such as the IBM Part No. 09G1246, which employs pulse width sensing to automatically supply the voltage and frequency appropriate to that of the receptacle to which the plug is connected. This power supply 16 also preferably includes a feature, heretofore proposed, of an indicator, such as a red light, which lights when no ground connection is established. However, if preferred, the plug may be separate from the power supply.

Normally, and as shown, upper portion 12 is vertically aligned with lower portion 14 and pairs of American, British, and European configured parallel, axially movable contact prongs 20, 22, 24, respectively, extend forward from the front face 26 of the upper portion. Formed integrally with and projecting from opposite side faces of upper portion 12 are rectangular wings 28 that extend from the front face 26 rearward a short distance parallel to the prongs 20, 22, 24. Upper portion 12 is manually slideable leftward, as viewed in FIG. 1, relative to lower housing portion 14 (and power supply 16, if used) to a forward position in which it overlies and hides the prongs 20, 22, 24. This permits insertion of the plug 10 into a recessed plug socket of the type used in Germany which has opposing slots to receive the wings 28. An American configured ground prong 30 and a British configured ground prong 32 normally extend forward of, but are axially slideable relative to, lower housing portion 14.

Figure 2:
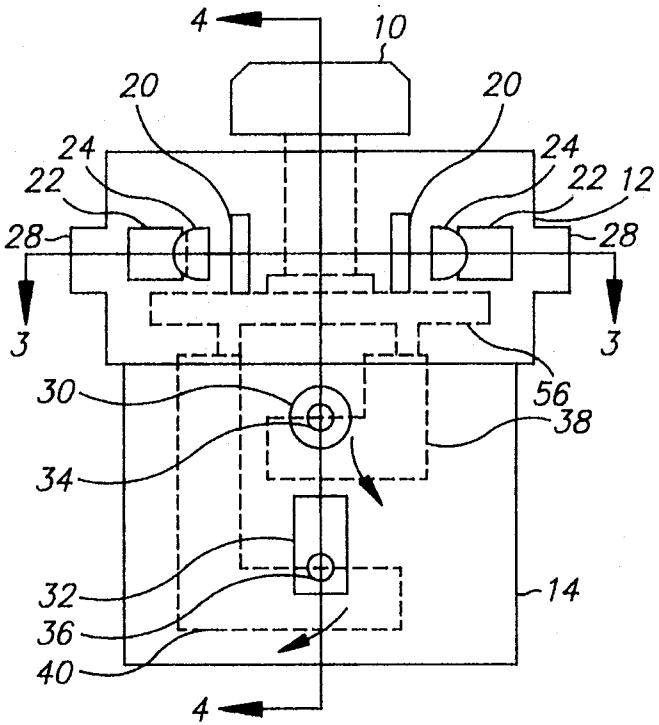
FIG. 2 is a front-end view, to enlarged scale, of the power plug portion shown in FIG. 1.
Figure 4:
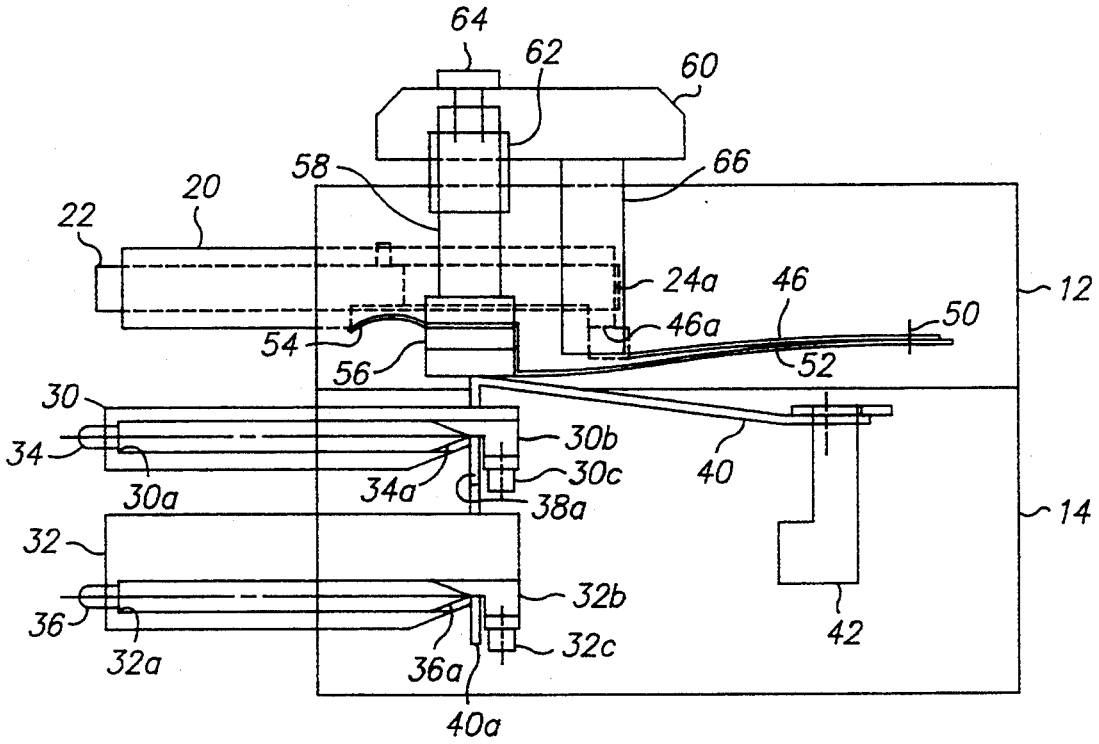
FIG. 4 is a vertical sectional view taken along the line 4—4 of FIG. 2.

As best shown in FIGS. 2 and 4, a plunger 34 is slideable in a bore in American ground prong 30 and a plunger 36 is slideable in a bore in British ground prong 32. Plungers 34, 36 are both normally biased to an extended position in which they are shown by fingers **38*a*, 40*a* of respective upward biasing leaf springs 38, 40**.

Note that the plungers 34, 36 have tapered ends which act as camming surfaces **34*a*, 36*a*. The spring fingers 38*a*, 40*a* are biased upward to the position in which they are shown in FIG. 4, blocking rightward movement of plungers 34, 36 relative to prongs 30, 32, respectively. Plungers 34, 36 are retained within prongs 30, 32 between stop shoulders 30*a*, 32*a* and end caps 30*b*, 32*b*, respectively. Note also that leaf springs 38, 40 are parallel to each other and serve as ground pins by their connection to an external ground strap 42 (FIG. 4) inserted in recess 44 (FIG. 1**).

Figure 5:
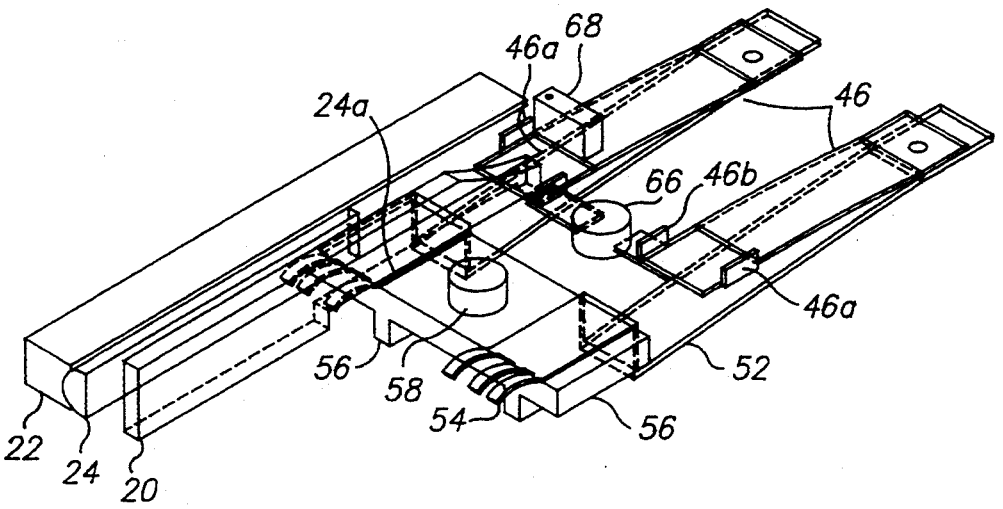
FIG. 5 is an isometric view of a spring-metal subassembly, shown in FIG. 4, that provides electrical connections to the various contact prongs of the plug.

As best shown in FIGS. 2 and 5, each American prong 20 is a thin rectangular blade or strip. Each British prong 22 has a semicylindrical longitudinally extending groove which accommodates an associated semicylindrical European prong 24. The European prong 24 may move in unison with and thus form a part of the British prong 22, but it is slideable axially relative to the British prong when required for a European plug.

As best shown in FIGS. 4 and 5, a generally U-shaped member 46 of spring metal has two pairs of upturned tabs or flanges **46*a*, 46*b* at its projecting ends. At its other end, it is secured at 50 to one end of two parallel strips 52 of spring metal that have wiping contact fingers 54 to provide electrical connections to selected prongs and are electrically isolated by a transverse insulating strip 56**.

A cylindrical plunger 58, slideable within a bore in upper housing portion 12, secures insulating strip 56 to a prong release member, such as a button 60. Encircling plunger 58 and seated against a shoulder in upper housing 12 is a helical spring 62 which biases button 60 upward, thereby permitting spring strips 52 and ground spring fingers **38*a*, 40*a* to assume the positions in which they are shown in FIG. 4. Spring 62 and a screw 64 that secures the button 60 to plunger 58 are electrically connected to external ground strap 42 to serve as the ground for the European contact prongs 24**.

Figure 3:
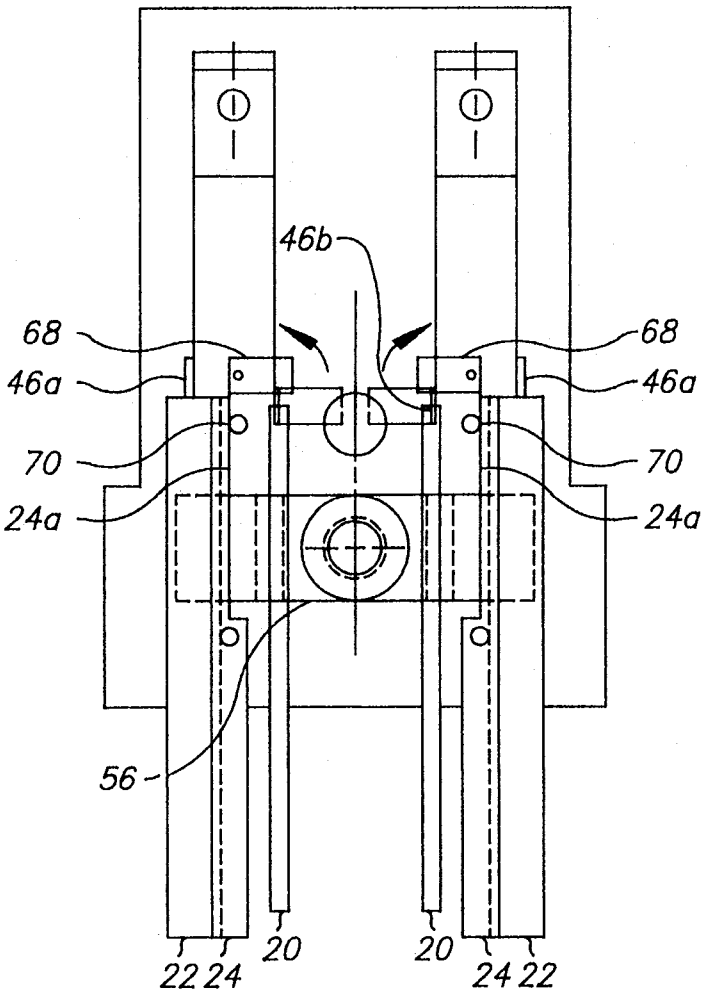
FIG. 3 is a longitudinal section view taken along the line 3—3 of FIG. 2.

Another cylindrical plunger 66, parallel to plunger 58, is also slideable within a bore in the upper housing 12. When button 60 is depressed, plunger 66 pushes down on U-shaped spring member 46, lowering tabs **46*a*, 46*b* and releasing a pivoted detent 68. This allows prongs 20, 22, 24 to extend either by gravity or by a flick of the user's wrist (similar to shaking a thermometer) to their positions, as shown in FIGS. 1, 3, and 4. In the manner presently to be described, this pivoted detent 68 can position the tabs 46*a*, 46*b* to secure the European and British prongs 22, 24 together for movement in unison as a British plug. Detent 68 also can act under differing wall socket configurations to selectively lock in retracted position the American, British, or European prongs 20, 22, 24**, respectively.

Note that robs **46*a* project rearward (as viewed in FIG. 5) further than tabs 46*b*, but that both tabs are of the same height. Also, longitudinally extending recesses 24*a* are on the bottlings of European prongs 24, and American prongs 20 are slightly shorter than the prongs 22, 24. Also to prevent short circuiting, the tips of the projecting ends of the prongs 20, 22, 24, 30, 32 are of, or are coated with, a suitable insulating material, such as plastic, and the plungers 34, 36** are preferably formed entirely of such material.

In operation, assume that with button 60 depressed, all prongs 20, 22, 24, 30, 32 and plungers 34, 36 are extended as shown in FIGS. 1, 3, and 4, and that button 60 is then released.

A. Use as a British Plug

With a British wall socket, there will be no openings to receive the American prongs 20 and ground prong 30.

In operation, prongs 20 will be pushed inward by contact with the wall and depress tabs 46*a*. This permits the prongs to pivot detents 68, as shown by the arrows in FIG. 3, to positions behind an associated European prong 24, thereby preventing prongs 24 from retracting into the housing. Concurrently, each tab 46*b* of U-shaped spring member 46 will drop down off the end of the American prongs 20 into positions behind prongs 22; as a result, both prongs 22 and 24 move in unison and jointly enter the wall and detent 68 and the prongs 20, 22, 24 will thus be positioned as shown in FIG. 6B.

Meanwhile, the finger 40*a*, as biased upward by leaf spring 40, will maintain prong 32 and its plunger 36 in their extended positions as British ground prongs 32 move into the wall socket openings. However, as plunger 34 of the American ground prong 30 strikes the wall, it will be driven inward. This will cause cam surface 34*a* to rock spring 38 downward below fixed pin 30*c*, thus freeing ground prong 30 so that it and plunger 34 may be pushed into the housing 14. Pin 30*c* serves to guide prong 30 and plunger 34 against cocking.

Figure 6A:
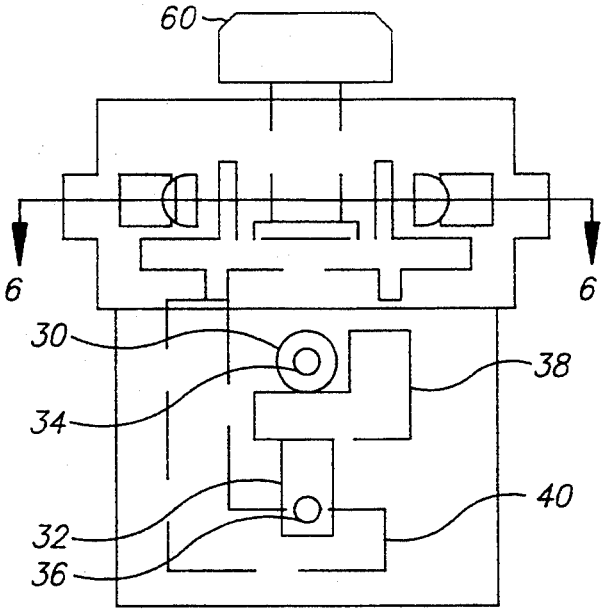
FIGS. 6A and 6B are, respectively, an end view, like FIG. 2, and a horizontal section view taken along the line 6—6 of FIG. 6A showing the plug configured as a British plug.
Figure 6B:
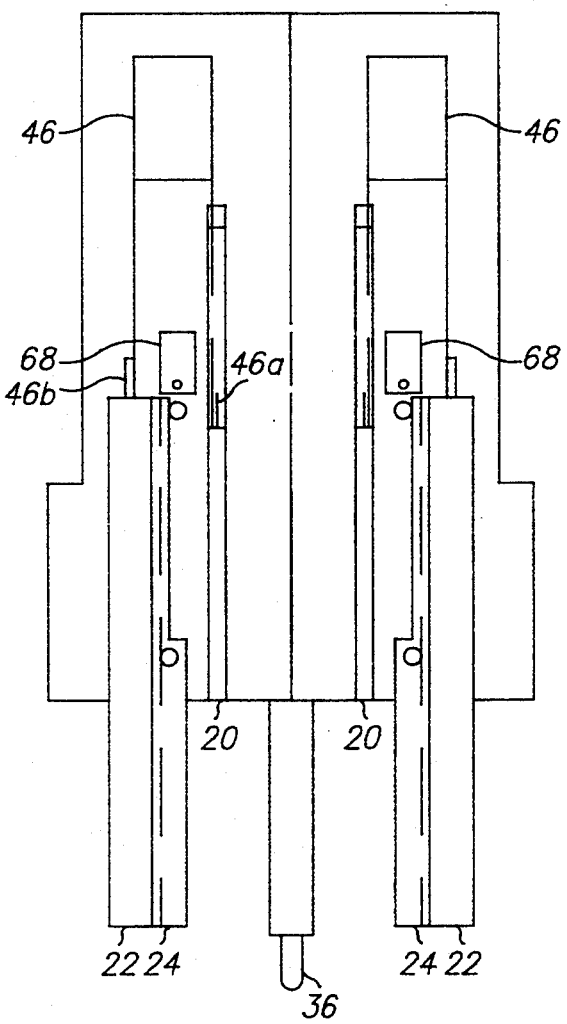

The various prongs and springs 38, 40 will then be positioned as shown in FIGS. 6A and 6B and configure the universal plug 10 as a British standard plug.

B. Use as a European Plug

With a European wall socket, there will be no openings to receive the prongs 20, 22 anti ground prong 30. In operation, prongs 22 will be driven in by contact with the wall slightly before the shorter American prongs 20. As a result, prongs 22 will pivot detents 68 to positions behind the European prongs 24 before prongs 20 are driven in. Since tabs 46*b* on leaf spring 46 will be unable to drop down off the end of prongs 20 to positions behind prongs 22, the latter can withdraw completely into housing 12.

American ground prong 30 will be driven inward, and British ground prong 32 will remain extended by operation similar to that described in A. above, except that grounding of the prong 32 is achieved by electrical connection to external ground strap 42.

Figure 7A:
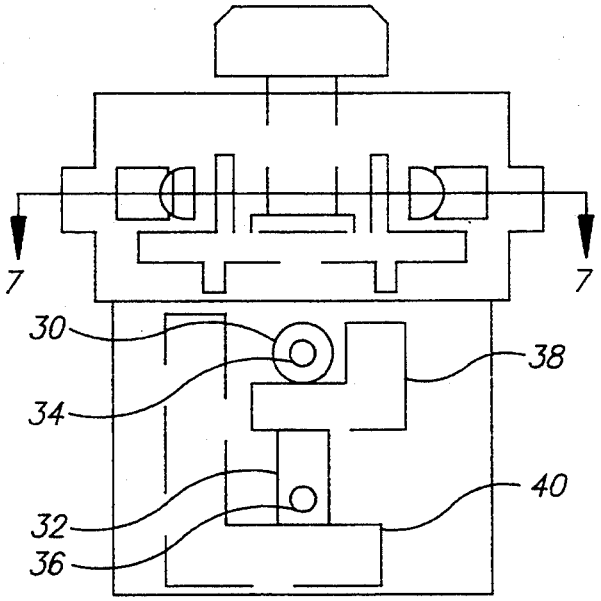
FIGS. 7A and 7B are, respectively, an end view, like FIG. 2, and a horizontal section view taken along the line 7—7 of FIG. 7A showing the plug configured as a European plug.
Figure 7B:
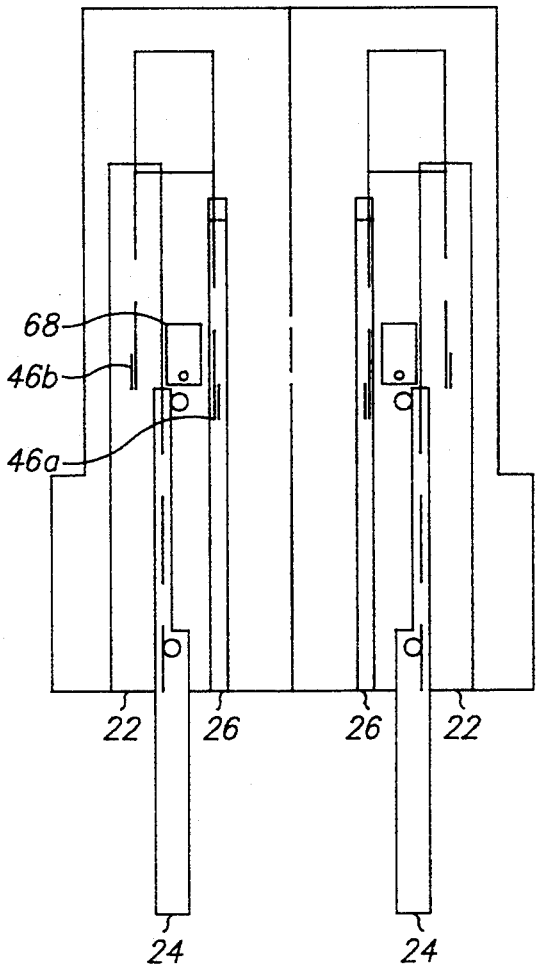

The various components will then be positioned as shown in FIGS. 7A and 7B and configure the universal plug 10 as a European standard plug.

C. Use as an American Plug

With an American socket, there will be no openings to receive prongs 22, 24 or ground prong 32. As prongs 22, 24 contact the wall, they will advance upward as viewed in FIG. 3, and prevent detents 68 from pivoting. This will lock prongs 20 them in extended position. During this movement, prongs 22, 24 will be guided against cocking by fixed pins 70 and ride over tabs 46*b*. Tabs 46*a* perform no function at this time.

Meanwhile, American ground prong 30 and plunger 34 will be maintained in extended position by spring 38*a* acting through cam surface 34*a* and shoulder 30*a* on prong 30. However, plunger 36 and thereby prong 32 will be driven inward, rocking finger 40*a* of spring 40 downward.

Figure 8A:
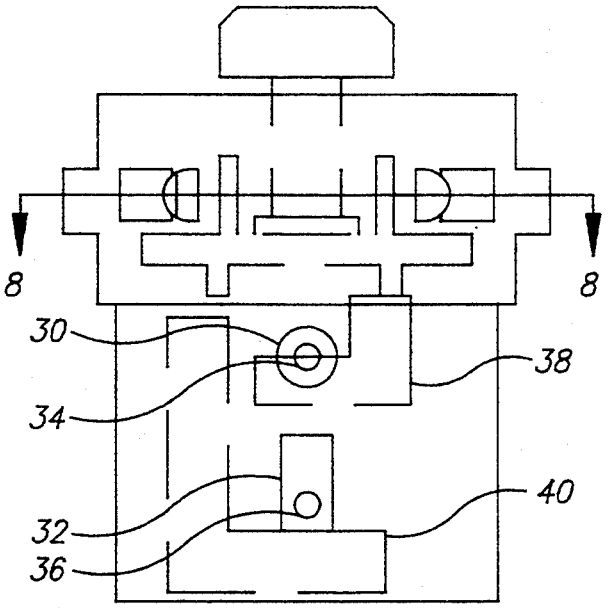
FIGS. 8A and 8B are, respectively, an end view, like FIG. 2, and a horizontal section view taken along the line 8—8 of FIG. 8A showing the plug configured as an American plug.
Figure 8B:
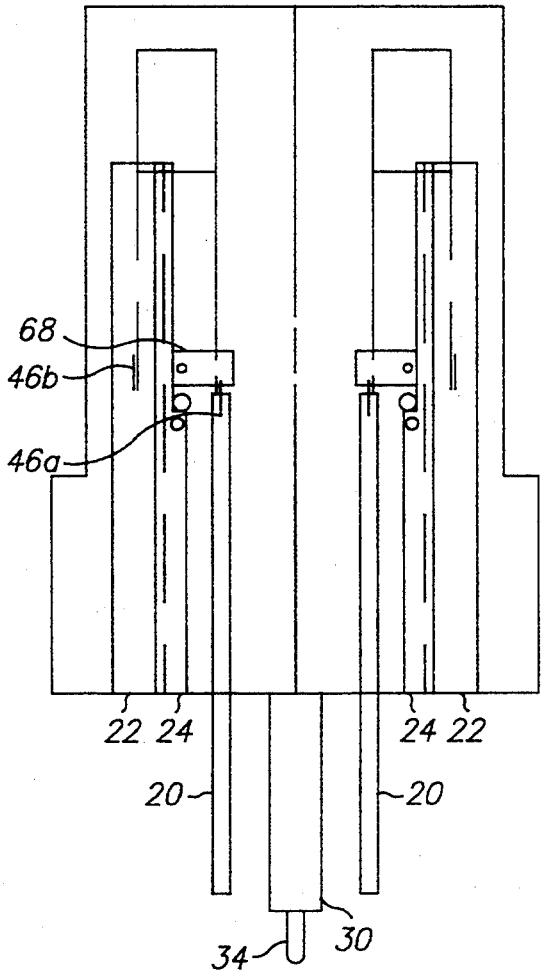

The various components will then be positioned as shown in FIGS. 8A and 8B and configure the universal plug 10 as an American standard plug.

D. Use as a German Plug

Upper housing portion 12 is manually shifted forward of lower housing portion 14, initially covering power prongs 20, 22, 24. Wings 28 are aligned with opposed openings in the recessed German standard socket. Upper housing portion 12 is then driven rearward as it is moved toward the wall and exposes prongs 20, 22, 24. Thereafter, the components of universal plug 10 operate in the same manner as described in section B for the European plug configuration.

After use for any of the plug configurations described in Sections A–D, the plug 10 is withdrawn from the socket. All prongs can be reset to their extended positions and thus conditioned for use as a differently configured plug merely by depressing button 60. This causes plunger 58, acting through insulating cross-strip 56, to lower fingers 54 from wiping contact with prongs 20, 22, 24 and also lower fingers 38*a*, 40*a* of springs 38, 40, respectively, below pins 30*c*, 32*c*. Concurrently, button 60 acts through plunger 66 to depress U-shaped spring 46 and thereby lower its tabs 46*a*, 46*b* for freeing pivoted detents 68. This enables prongs 20, 22, 24, 30, and 32 to be moved out to their respective extended positions by gravity or a flick of the user's wrist.

Button 60 is then released and biased upward by spring 62. Contact fingers 54 will again make wiping contact with and frictionally retain prongs 20, 22, 24; tabs 46*a*, 46*b* will move upward; and springs 38, 40 will act through fingers 38*a*, 40*a* to retain the ground prongs 30, 32 and their plungers 34, 36 in their extended positions. The various components will now once again be positioned as shown in FIGS. 1–4.

E. Variations

It will be apparent that, as an obvious variation of the invention, some of the prongs 20, 22, 24, 30, 32 may be eliminated and/or some of the prongs retained may be made nonretractable from their extended position. For example, prongs 22, 24 and European ground prong 32 could be eliminated, and American prongs 20 fixed, and the American ground prong 32 and its plunger 36 retractable and operable in the same manner as already described. In such event, the plug would be insertable into wall sockets or other receptacles that have a ground connection and into those that do not.

Figure 9A:
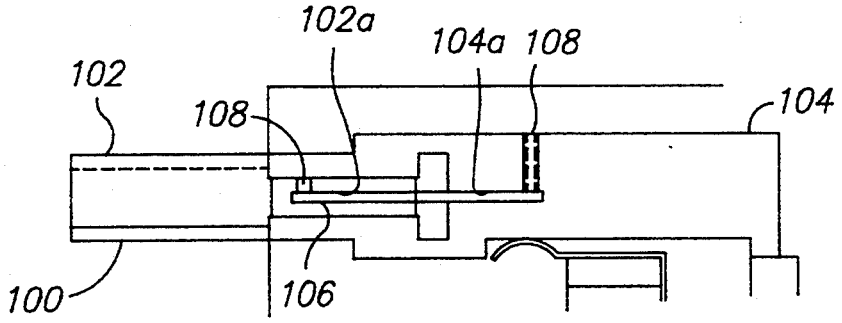
FIGS. 9A and 9B are, respectively, a longitudinal section and an end view of a contact prong which may be used to implement a modified embodiment of the invention.
Figure 9B:
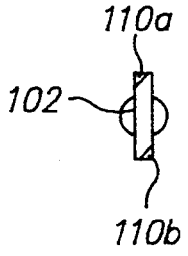

To simplify the preceding description, prongs 20 were shown as thin rectangular blades or strips. However, prongs 20 may be replaced by prongs 100 if it is desired to adapt the plug for selective use with an American socket with parallel apertures or an Australian/New Zealand socket with angled apertures. As illustrated in FIGS. 9A and 9B, each prong 100 comprises two abutting thin rectangular blades or strips 102, 104 with aligned, centrally positioned bores 102*a*, 104*a* extending inwardly substantial distances from their abutting ends. A torsion bar 106 extends into bores 102*a*, 104*a* and adjacent to its ends is suitably secured to strips 102, 104 such as by screws 108. Strips 104 of each prong 100 (like prong 20) are longitudinally movable but not rotatable. However, each strip 102 is rotatable, against resistance of torsion bar 106, from a position in parallel alignment with associated strip 104 to an angled position relative to the associated strip. The outer ends of strips 102 are obliquely and reversely chamfered, as at 110*a*, 110*b*, to facilitate aligning entry and concurrent twisting of said strips relative to their associated strips 104 as permitted by torsion bar 106 during penetration of an angled aperture in an Australian/New Zealand socket. Upon withdrawal from the angled aperture, the twisting moment on the torsion bar 106 will be relieved and bias each strip 102 to its aligned position parallel to its associated strip 104.

While the invention has been shown and described with respect to preferred embodiments thereof, it will be understood that various changes may be made without departing from the teachings of the invention. Therefore, the invention is not to be deemed limited except to the extent proscribed by the claims.

We claim:

1. An electrical plug selectively insertable into receptacles having different configurations of apertures for effecting selectable electrical connections, said plug comprising:

a housing means; and a plurality of contact prongs having extended positions in which they project exteriorly of the housing means, an appropriate subset of said prongs being adapted automatically to sense and enter matching apertures of a selected receptacle, the remaining prongs during such entry being moved inward of the housing means by contact with and movement relative to a surface of the selected receptacle adjacent to the apertures.

2. The plug of claim 1, including means within the housing means conditioned by such inward movement of at least one of said remaining prongs for latching at least some of the prongs of said subset in extended position as they enter the matching apertures.

3. The plug of claim 1, including a single release means manually operable from a normal position to another position to concurrently free all contact prongs from restraint and permit them to be restored to their extended positions.

4. The plug of claim 3, including means for frictionally retaining said contact prongs in their extended positions upon return of said release means to normal position.

5. The plug of claim 1, wherein some of said prongs are slidably accommodated in others of said prongs to constitute different prong configurations according to whether said some and other prongs are substantially longitudinally aligned or longitudinally offset.

6. The plug of claim 1, wherein said contact prongs include a pair of rectangular prongs having facing longitudinally extending semicylindrical grooves and a pair of semicylindrical prongs slidably accommodated in said grooves, and including means for latching the rectangular prongs and semicylindrical prongs together to constitute a British-type prong, said rectangular prongs being movable longitudinally inward of the housing means and relative to said semicylindrical prongs to constitute a European prong.

7. The plug of claim 1, wherein two of said prongs each comprises two normally aligned rectangular blade members and an element interconnecting said blade members in such a manner as to permit one of said members to twist relative to the other member, each said one member having a chamfered aperture-sensing end to facilitate sensing and concurrent twisting thereof during entry into an angled aperture.

8. The plug of claim 7, wherein each said one member is torsionally biased so as to be normally aligned parallel with its associated said other member.

9. The plug of claim 1, wherein two of said prongs each comprises two normally parallel aligned, substantially abutting rectangular blade members having centrally located elongated bores, one of said blade members being constrained against rotation, and a torsion bar disposed within said bores and secured adjacent to its ends to each of said blade members to permit the other of said blade members to twist relative to said one blade member, each said other blade member having a chamfered aperture-sensing end to facilitate sensing of and concurrent twisting thereof during entry into an angled aperture.

10. The plug of claim 1, wherein said housing means has one portion which in one position covers at least some of the prongs and extends forwardly of another housing portion, said one portion being insertable into a recessed receptacle and slidable rearwardly relative to said another housing portion by engagement with said surface for progressively uncovering said subset of prongs as they enter said apertures.

11. The plug of claim 1, including release means manually depressible to permit all contact pins to be restored to their extended position by a flick of the user's wrist.

12. The plug of claim 1, including, forming integrally therewith, a power supply unit utilizing pulse width sensing to automatically adjust voltage to that appropriate for said selected receptacle.

13. An electrical plug selectively insertable into receptacles having different configurations of apertures for effecting selectable electrical connections, said plug comprising:

a housing means;

a plurality of contact prongs having extended positions in which they project exteriorly of the housing means, an appropriate subset of said prongs being adapted automatically to sense and enter matching apertures of a selected receptacle, the remaining prongs during such entry being moved inward of the housing means by contact with and movement relative to a surface of the selected receptacle adjacent to the apertures;

means within the housing means for latching the prongs of said subset in extended position as they enter the matching apertures;

means for guiding said remaining prongs as they are forced inwardly of the housing means; and release means manually operable to concurrently free all contact prongs from restraint for permitting them to be restored to their extended positions.

14. An electrical plug selectively insertable into receptacles having different configurations of apertures for effecting selectable electrical connections, said plug comprising:

a housing means; and a plurality of contact prongs including a pair of fixed power prongs that extend from the housing means and a pair of longitudinally slidable ground prongs having extended positions in which they project exteriorly of the housing means, said ground prongs being operative during entry of the power prongs into a selected receptacle to automatically sense and enter aligned matching apertures in said receptacle or move inwardly of the housing means by contact with and movement relative to a surface of said receptacle in the absence of said matching apertures.

15. An electrical plug selectively insertable into receptacles having different configurations of apertures for effecting selectable electrical connections, said plug comprising:

a housing means; and a plurality of contact prongs comprising a pair of prongs having extended positions in which they project exteriorly of the housing means, each prong of said pair comprising two normally aligned rectangular blade members and an element interconnecting said members in such a manner as to permit one of said members to twist relative to the other member, said one members being biased to respective positions in which they are parallel to each other and adapted to enter parallel apertures in a selected receptacle without twisting, said one members having chamfered aperture-sensing ends to facilitate sensing and concurrent twisting during entry into angled apertures in said selected receptacle.

* * * * *